US008290412B2

(12) United States Patent
Masui

(10) Patent No.: US 8,290,412 B2
(45) Date of Patent: Oct. 16, 2012

(54) ENDLESS BELT, TRANSFER UNIT, AND IMAGE FORMING APPARATUS

(75) Inventor: Naoki Masui, Tokyo (JP)

(73) Assignee: Oki Data Corporation, Tokyo (JP)

( * ) Notice: Subject to any disclaimer, the term of this patent is extended or adjusted under 35 U.S.C. 154(b) by 713 days.

(21) Appl. No.: 12/365,271

(22) Filed: Feb. 4, 2009

(65) Prior Publication Data

US 2009/0202280 A1 Aug. 13, 2009

(30) Foreign Application Priority Data

Feb. 13, 2008 (JP) ..... 2008-031402

(51) Int. Cl.
*G03G 15/16* (2006.01)

(52) U.S. Cl. ..... 399/297; 399/302

(58) Field of Classification Search ..... 399/162, 399/297, 302, 303, 308, 312, 313, 329
See application file for complete search history.

(56) References Cited

U.S. PATENT DOCUMENTS

2002/0009314 A1* 1/2002 Nakayama ..... 399/297
2003/0206749 A1* 11/2003 Kashiwabara et al. ..... 399/121

FOREIGN PATENT DOCUMENTS

| | | | |
|---|---|---|---|
| JP | 2000118818 A | * | 4/2000 |
| JP | 2001-099248 | | 4/2001 |
| JP | 2002-251078 | | 9/2002 |
| JP | 2006-259248 | | 9/2006 |
| JP | 2006-268029 A | | 10/2006 |
| JP | 2007-256507 A | | 10/2007 |
| JP | 2008-003459 | | 1/2008 |

* cited by examiner

*Primary Examiner* — Walter L Lindsay, Jr.
*Assistant Examiner* — Ruth Labombard
(74) *Attorney, Agent, or Firm* — Marvin A. Motsenbocker; Mots Law, PLLC

(57) ABSTRACT

An aspect of the invention provides an endless belt in which a ten-point mean roughness of a surface of the endless belt is measured with scanning probe and is in a range from not less than 2.1 nm to not more than 11.0 nm. Thereby, poor transfer does not occur, and a highly fine image of high quality can be obtained.

26 Claims, 5 Drawing Sheets

FIG. 3

| DRYING TIME (MINUTES) | 40 | 50 | 55 | 60 | 70 | 85 | 100 | 110 | 115 | 150 |
|---|---|---|---|---|---|---|---|---|---|---|
| WEIGHT CONCENTRATION OF RESIDUAL SOLVENT [wt%] | 0.7 or more | 0.6 | 0.53 | 0.5 | 0.47 | 0.44 | 0.37 | 0.28 | 0.2 | 0.1 |
| TEN-POINT MEAN ROUGHNESS | 18.5 | 17.5 | 11.0 | 10.6 | 9.1 | 7.0 | 5.5 | 3.8 | 2.1 | 1.5 |
| IMAGE DENSITY | 0.7 | 0.8 | 1.0 | 1.1 | 1.2 | 1.2 | 1.3 | 1.3 | 1.3 | — |
| EVALUATION | POOR | POOR | GOOD | GOOD | EXCELLENT | EXCELLENT | EXCELLENT | EXCELLENT | EXCELLENT | POOR |

FIG. 5

| TEN-POINT MEAN ROUGHNESS / COEFFICIENT OF FRICTION | 18.5 | 17.5 | 11.0 | 10.6 | 9.1 | 7.0 | 5.5 | 3.8 | 2.1 | 1.5 |
|---|---|---|---|---|---|---|---|---|---|---|
| 3.24 | POOR | POOR | POOR | POOR | POOR | POOR | POOR | POOR | POOR | POOR |
| 2.58 | POOR | POOR | POOR | POOR | POOR | POOR | POOR | POOR | POOR | POOR |
| 2.05 | POOR | POOR | POOR | POOR | POOR | POOR | POOR | POOR | POOR | POOR |
| 1.40 | POOR | POOR | GOOD | GOOD | GOOD | GOOD | GOOD | GOOD | GOOD | POOR |
| 1.20 | POOR | POOR | GOOD | GOOD | EXCELLENT | EXCELLENT | EXCELLENT | EXCELLENT | EXCELLENT | POOR |
| 1.00 | POOR | POOR | GOOD | GOOD | EXCELLENT | EXCELLENT | EXCELLENT | EXCELLENT | EXCELLENT | POOR |
| 0.70 | POOR | POOR | GOOD | GOOD | EXCELLENT | EXCELLENT | EXCELLENT | EXCELLENT | EXCELLENT | POOR |
| 0.30 | POOR | POOR | GOOD | GOOD | EXCELLENT | EXCELLENT | EXCELLENT | EXCELLENT | EXCELLENT | POOR |
| 0.01 | POOR | POOR | GOOD | GOOD | EXCELLENT | EXCELLENT | EXCELLENT | EXCELLENT | EXCELLENT | POOR |

ENDLESS BELT, TRANSFER UNIT, AND IMAGE FORMING APPARATUS

CROSS REFERENCE TO RELATED APPLICATIONS

This application claims priority based on 35 USC 119 from prior Japanese Patent Application No. P2008-031402 filed on Feb. 13, 2008, entitled "Endless Belt, Transfer Unit, and Image Forming Apparatus", the entire contents of which are incorporated herein by reference.

BACKGROUND OF THE INVENTION

1. Field of the Invention

The present invention relates to an endless belt, a transfer unit, and an image forming apparatus.

2. Description of the Related Art

An endless belt using a base material of polyamide-imide has been proposed as an endless belt used in an image forming apparatus. However, in a case where a highly fine image is required, a satisfactory image has not been obtained by use of the conventional endless belt mentioned above.

SUMMARY OF THE INVENTION

An aspect of invention provides an endless belt that comprises: a surface whose ten-point mean roughness measured with a scanning probe microscope is not less than 2.1 nm and not more than 11.0 nm.

According to the above-mentioned endless belt, a highly fine image of high quality can be obtained.

Another aspect of invention provides a transfer unit that comprises: an endless belt including a surface whose ten-point mean roughness measured with a scanning probe microscope is not less than 2.1 nm and not more than 11.0 nm; a driving roller configured to travel the endless belt; a following roller configured to be driven by rotation of the driving roller; and a transfer member configured to transfer a developer image on an image carrier onto a medium or the endless belt.

Another aspect of invention provides an image forming apparatus that comprises: a medium accommodation part configured to accommodate a medium; a medium conveyance part configured to convey the medium; an image formation unit configured to form a developer image based on image data; a transfer unit configured to transfer the developer image formed by the image formation unit onto the medium; and a fixing part configured to fix the developer image onto the medium; wherein the transfer unit comprises: an endless belt including a surface whose ten-point mean roughness measured with a scanning probe microscope is not less than 2.1 nm and not more than 11.0 nm; a driving roller configured to travel the endless belt; a following roller configured to be driven by rotation of the driving roller; and a transfer member configured to transfer a developer image on an image carrier onto a medium or the endless belt.

BRIEF DESCRIPTION OF THE DRAWINGS

FIG. 3 is a diagram showing a relationship between evaluation of an endless belt and a period of time of drying performed in manufacturing the endless belt according to the first embodiment.

FIG. 5 is a diagram showing a relationship among the ten-point mean roughness and the coefficient of friction of an endless belt according to a second embodiment, and the quality of a printed image.

DETAILED DESCRIPTION OF EMBODIMENTS

Figure 1:
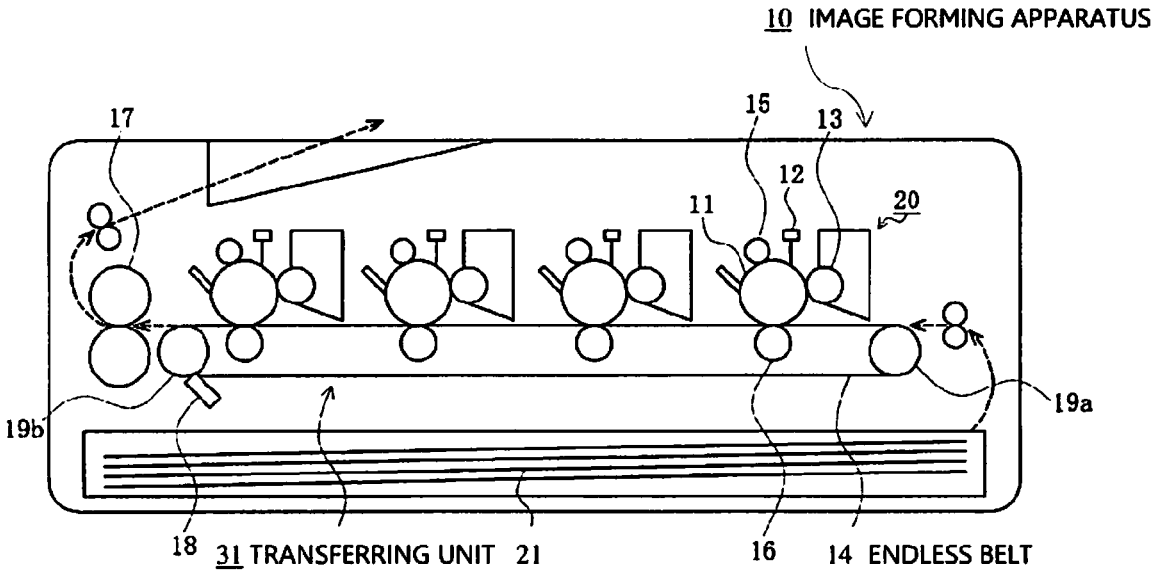
FIG. 1 is a diagram showing a configuration of an image forming apparatus according to a first embodiment.

Embodiments of the invention are explained with referring to drawings. In the respective drawings referenced herein, the same constituents are designated by the same reference numerals and duplicate explanation concerning the same constituents is basically omitted. All of the drawings are provided to illustrate the respective examples only. No dimensional proportions in the drawings shall impose a restriction on the embodiments. For this reason, specific dimensions and the like should be interpreted with the following descriptions taken into consideration. In addition, the drawings include parts whose dimensional relationship and ratios are different from one drawing to another.

FIG. 1 is a diagram showing a configuration of an image forming apparatus according to the first embodiment. In FIG. 1, reference numeral 10 denotes an image forming apparatus according to the embodiment. While the image forming apparatus is, for example, a printer, a facsimile machine, a copying machine, a multifunction machine having various kinds of functions, or the like, the image forming apparatus may be any type of the above apparatus. Here, description is given on the assumption that the image forming apparatus is a printer. Moreover, while image forming apparatus 10 may be an image forming apparatus using any type of printing methods such as the inkjet method, the electrophotographic method, and the thermal transfer method, here, description is given as a case where image forming apparatus 10 is an electrophotographic printer using the electrophotographic method. Additionally, while image forming apparatus 10 may be a monochrome printer that forms a monochrome image, here, description is given of a case where image forming apparatus 10 is a color printer that forms a color image.

In this case, image forming apparatus 10 is a color electrophotographic printer adapting direct transfer system of a so-called tandem system. The tandem systems shown in FIGS. 1 and 2 include four process units that are cyan, magenta, yellow, and black are arranged in tandem along a path for recording medium or intermediate transfer belt, and forms a color image on recording medium. The image forming apparatus 10 accommodates recording media 21 such as print sheets inside the apparatus, with recording media 21 stacked on each other. Image forming apparatus 10 includes a sheet feeding part configured to supply recording medium 21 one by one; an image formation unit configured to transfer a toner image of each color onto conveyed recording medium 21 to form an image; a fixing part configured to fix the transferred toner image onto recording medium 21; and a sheet discharging part configured to convey recording medium 21 with the toner image fixed thereon to an outside of a body of image forming apparatus 10.

The image formation unit includes four process units 20 that are arranged in tandem along a conveying path for recording medium 21 and that each form an image in each color of yellow, magenta, cyan, and black; endless belt 14 that functions as a conveyance belt that carries and conveys recording medium 21; transfer roller 16 that functions as transferring; and transfer unit 31 including cleaning blade 18 as a cleaning member configured to remove toner or the like remaining on a surface of endless belt 14.

Each of process units 20 provided in the image formation unit includes photosensitive drum 11 as an image carrier; charging roller 15 as charging member configured to supply charges to a surface of the photosensitive drum 11; light emitting diode (LED) head 12 as exposing member configured to form an electrostatic latent image on the surface of photosensitive drum 11 after completion of charging; development unit 13 as developing member configured to supply toner as a developer to the electrostatic latent image on photosensitive drum 11 and develop the electrostatic latent image for the purpose of forming a toner image; and a cleaning device configured to remove the toner remaining on the surface of photosensitive drum 11 after the toner image is transferred onto recording medium 21. While LED head 12 forms a highly fine image having a resolution of approximately 1200 dpi to 2400 dpi, in the embodiment, description is given of a case where LED head 12 for a resolution of 1200 dpi is used.

Endless belt 14 provided in transfer unit 31 is looped around driving roller 19*a* and following roller 19*b*, and is stretched by unillustrated tension member formed of a spring. Tension given to endless belt 14 by the tension member is, for example, 6 kg±10%. Driving roller 19*a* is rotated by a driving source such as an unillustrated motor. Thereby, endless belt 14 is rotated to convey recording medium 21.

Additionally, endless belt 14 includes a belt shift prevention member. Belt shift is prevented by guiding the belt shift prevention member by an unillustrated belt pulley. The belt shift prevention member can also be attached to both side ends of endless belt 14.

Transfer roller 16 is arranged facing photosensitive drum 11 with endless belt 14 being sandwiched in between. Transfer roller 16 transfers the toner image on photosensitive drum 11 onto recording medium 21 conveyed by endless belt 14. Then, recording medium 21 conveyed by endless belt 14 passes through process unit 20 of each color, and is subjected to transfer of a toner image of each color thereon, removed from endless belt 14, and then sent to the fixing part.

Moreover, the fixing part includes fixing unit 17 including a heating roller, a pressure roller and the like. The toner image transferred on recording medium 21 is fixed onto recording medium 21. Then, recording medium 21 on which the toner image is fixed is discharged to the outside of the body of image forming apparatus 10. Meanwhile, the surface of endless belt 14 after removal of the recording medium 21 therefrom is cleaned by cleaning blade 18, so that the remaining toner and other foreign substances are removed.

Figure 2:
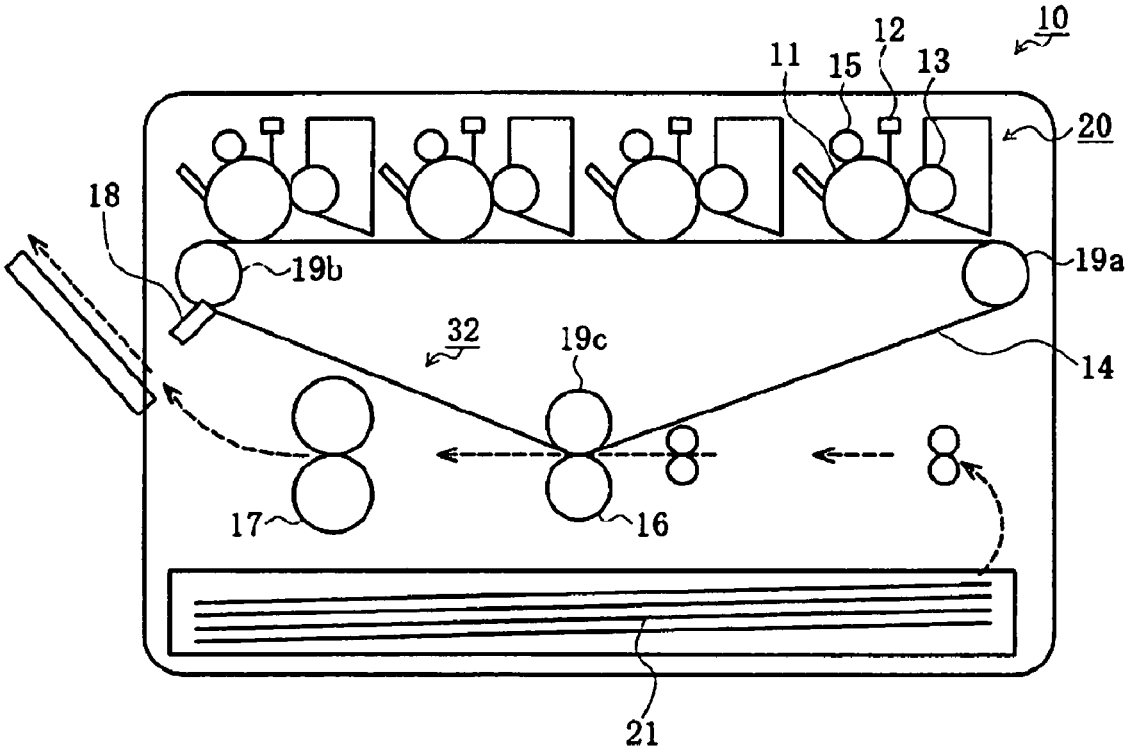
FIG. 2 is a diagram showing a configuration of a modification of the image forming apparatus according to the first embodiment.

Next, a modification of the image forming apparatus 10 is described. FIG. 2 is a diagram showing a configuration of a modification of the image forming apparatus according to the first embodiment.

Image forming apparatus 10 shown in FIG. 2 is a color electrophotographic printer similarly to image forming apparatus 10 shown in FIG. 1, however, is different from image forming apparatus 10 employing the so-called direct transfer system shown in FIG. 1 in that image forming apparatus 10 shown in FIG. 2 employs an intermediate transfer system of so-called tandem system. Specifically, in the tandem system, a toner image formed by each process unit 20 is directly transferred onto recording medium 21. On the other hand, in the intermediate transfer system, a toner image formed by each process unit 20 is once transferred onto a surface of an intermediate transfer belt of intermediate transfer unit 32, and then the toner image on the surface of the intermediate transfer belt is transferred onto recording medium 21.

For that reason, in image forming apparatus 10 shown in FIG. 2, endless belt 14 functions as an intermediate transfer belt, and is also looped around second following roller 19*c*. Moreover, transfer roller 16 is arranged facing second following roller 19*c* with endless belt 14 being sandwiched therebetween, and transfers the toner image on the surface of endless belt 14 onto conveyed recording medium 21. Additionally, cleaning blade 18 removes the toner that remains on the surface of endless belt 14 after the toner image is transferred onto recording medium 21.

Note that, since other points are the same as those of image forming apparatus 10 shown in FIG. 1, description thereof is omitted.

Next, endless belt 14 is described in detail. In the embodiment, a polyamide-imide (hereinafter, "PAI") is used as a material for endless belt 14, and an appropriate amount of carbon black is mixed with the PAI for development of conductivity. The PAI including the carbon black is stirred in a solution of N-methylpyrrolidone (hereinafter, "NMP") so as to be mixed. The resultant mixture is molded by rotational molding to have a thickness of 100 μm±10 μm and an aperture of ϕ198, and then, the molded product is cut off to have a width of 230 mm±0.5 mm.

Endless belt 14 according to the embodiment thus obtained has the characteristics as follows: volume resistivity is 1.0e-9 Ω·cm to 1.0e-12 Ω·cm, surface resistivity is 2.02e-12 $\Omega/cm^2$ to 1.0e-14 $\Omega/cm^2$, and macroscopic roughness is 0.2 μm to 0.4 μm. Moreover, endless belt 14 has a belt thickness t of 0.1 mm.

The PAI is a polymer obtained by bonding an amide group and one to two imide groups through an organic group to form one unit repeatedly. Additionally, the PAI is classified into an aliphatic PAI or an aromatic PAI depending on whether the organic group is an aliphatic or aromatic. However, in the embodiment, from a viewpoint of durability and mechanical characteristics, the PAI is preferably an aromatic PAI that is expressed by the following chemical formula (1):

[Chemical formula 1]

Formula (1)

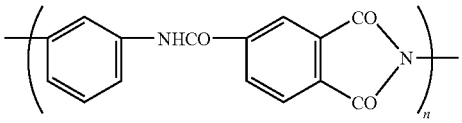

Basically, "aromatic" means that the organic group is one or two benzene rings to which the imide group and the amide group bond.

Furthermore, the PAI may be a PAI in which imide ring closure reaction is completed, or may be at a stage of amic acid in which the imide ring closure reaction is not completed. However, it is desirable to use the PAI in which at least not less than 50% of imidization, and preferably, not less than 70% of imidization is completed. This is because a dimensional change ratio is larger when the PAI includes a larger amount of a product at the stage of amic acid.

The material of endless belt 14 is not limited to the PAI used in the embodiment, and other materials may be used. In this case, from the viewpoint of durability and mechanical characteristics, the material preferably has a fixed range of deformation caused by tension in the driving of endless belt 14. Moreover, material preferably has resistance to damages such as wear and fold at an end portion, crack, or the like, resulting from repeated sliding of the belt shift prevention member.

For example, similarly to the PAI used in the embodiment, resins such as polyimide (PI) having a Young's modulus of not less than 2000 MPa, preferably, not less than 3000 MPa, polycarbonate (PC), polyamide (PA), polyether ether ketone (PEEK), polyvinylidene fluoride (PVDF), ethylene-tetrafluoroethylene copolymer (ETFE), and a mixture mainly made of each of the above-mentioned resins may be used.

Furthermore, for example, trimellitic anhydride, aromatic diamine, carbon black, or the like may be used as a composition component of endless belt 14. Trimellitic anhydride and aromatic diamine are a main raw material (monomer) that forms endless belt 14, and both are a material that influences the physical properties of endless belt 14. Trimellitic anhydride can form crosslinking points, and therefore is rather a component that contributes to rigidity of endless belt 14. By contrast, aromatic diamine is a molecule to connect the crosslinking points, and is rather a component that contributes to elasticity of endless belt 14. Both of trimellitic anhydride and aromatic diamine have aromatic rings. Accordingly, due to interaction of the aromatic rings, trimellitic anhydride and aromatic diamine can contribute to an organic polarity or rigidity, and demonstrate wear resistance and chemical resistance. Moreover, while carbon black is added as an electric conductive material for a main purpose, addition and dispersion of the carbon black in the polymeric materials contributes to hardness (rigidity) of endless belt 14.

Then, in manufacturing endless belt 14 by rotational molding, a solvent is determined where relevant depending on the material in use. Usually, an organic polar solvent is used, and particularly, N,N-dimethyl formamides are effective. For example, N,N-dimethyl formamides includes N,N-dimethylformamide, N,N-dimethylacetamide, N,N-diethylformamide, N,N-diethylacetamide, dimethyl sulfoxide, the NMP, pyridine, tetramethylen sulfone, dimethyltetramethylen sulfone, and the like. These organic polar solvents may be used alone, or may be used in combination. Also when a cylindrical ring shape metal mold is used to form a layer of endless belt 14 in the space of the mold, these organic solvents are used in a similar manner to the above-mentioned case. Meanwhile, molding without a solvent is possible in a case of so-called extrusion molding.

Carbon blacks include furnace black, channel black, Ketchen black, acetylene black, and the like. These may be used alone or may be used in combination with several types of these carbon blacks. While these types of carbon blacks can be selected where relevant depending on conductivity to be aimed at, the channel black and the furnace black are particularly suitably used for endless belt 14 used for image forming apparatus 10 in the embodiment. Moreover, depending on application, the following carbon blacks are preferably used: carbon blacks subjected to a process to prevent oxidative deterioration, such as oxidation treatment, grafting; and carbon blacks having improved dispersibility to a solvent. The content of the carbon black is determined where relevant depending on the purpose and the type of the carbon black to be added. In endless belt 14 used for image forming apparatus 10 in the embodiment, from a viewpoint of mechanical strength, the content of the carbon black is 3% to 40% by weight relative to a resin solid content of the belt composition, and more preferably, 3% to 30% by weight.

Meanwhile, driving roller 19*a* being belt driving member configured to drive endless belt 14, following roller 19*b*, and second following roller 19*c* all have an outer diameter of ϕ25 in the embodiment, however, the outer diameter is not limited to this value. Similarly to a case of common printers, depending on costs and size of image forming apparatus 10, the outer diameter of the belt driving member can be selected where relevant, preferably in a range of ϕ10 to 50.

Furthermore, in the embodiment, description has been given of an example in which a spring is used as the tension member configured to stretch endless belt 14, so that endless belt 14 is stretched with a tension of 6 kg±10%. However, the method for stretching endless belt 14 is not limited to this. Additionally, while the tension with which endless belt 14 is stretched is also selected where relevant depending on the material of endless belt 14 to be used and the belt driving member, the tension is usually 2 kg to 8 kg±10% relative to endless belt 14.

Figure 4:
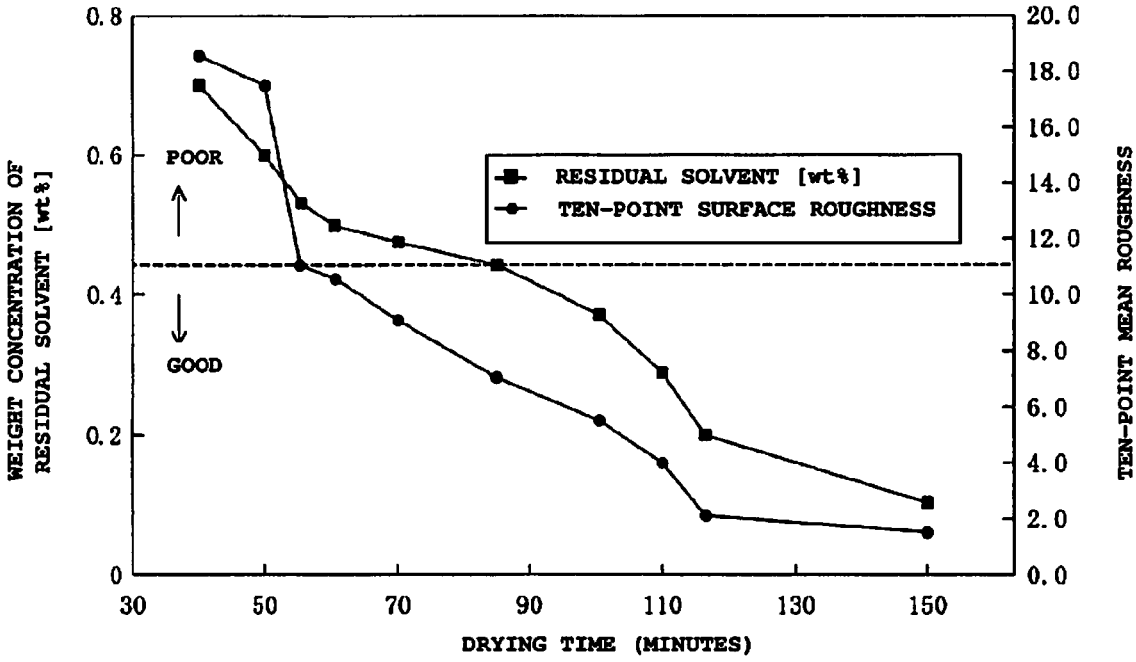
FIG. 4 is a diagram showing a relationship between a ten-point mean roughness and a period of time of drying performed in manufacturing the endless belt according to the first embodiment.

Next, an evaluation method of endless belt 14 is described. FIG. 3 is a diagram showing a relationship among evaluation results of an endless belt and a period of time of drying performed when the endless belt according to the first embodiment is manufactured. FIG. 4 is a diagram showing a relationship between a ten-point mean roughness and a period of time of drying performed when the endless belt according to the first embodiment is manufactured. In FIG. 4, a horizontal axis shows the drying time and a vertical axis shows the ten-point mean roughness.

First, description is given of a secondary drying process to volatilize the solvent used in molding endless belt 14.

In the embodiment, in order to control a microscopic surface roughness of endless belt 14, the secondary drying process to volatilize the solvent used in molding endless belt 14 is performed, for example, under an environment of 250° C. and for each of different process times of 40 minutes, 50 minutes, 55 minutes, 60 minutes, 70 minutes, 85 minutes, 100 minutes, 110 minutes, 115 minutes, and 150 minutes.

As a result, a relationship between the process time, i.e., the drying time (minutes) and a weight concentration of a residual solvent (wt %), as shown in FIG. 3, can be obtained. FIG. 4 depicts a graph showing the relationship between the drying time (minutes) and the weight concentration (wt %) of the residual solvent. This shows that an amount of the residual solvent of endless belt 14 reduces as the drying time becomes longer.

Thus, in the embodiment, the microscopic surface roughness of endless belt 14 is controlled in accordance with the temperature and period of time for removing the solvent. Thus, the process is performed at a constant temperature (approximately 250° C.). An amount of the solvent that vaporizes in the secondary drying process is approximately 0.3% by weight, and is approximately 30 g based on a calculation from a weight of the product. For this reason, the amount of the solvent that vaporizes with respect to endless belt 14 does not change under conditions that image forming apparatus 10 operates as a printer (for example, approximately 5° C. to 50° C.). Moreover, since the solvent does not vaporize at room temperature, vaporization of the solvent does not cause the microscopic surface roughness of endless belt 14 to be changed after the secondary drying process to volatilize the solvent.

As a result, ten types of endless belts 14 each having a different value of the surface roughness (ten-point mean roughness) as shown in FIG. 3 can be obtained. Note that the surface roughness shown in FIG. 3 is measured in the following manner.

Subsequently, measurement of the microscopic surface roughness of endless belt 14 is described.

In the embodiment, the surface roughness Rz of a fine area on the surface of endless belt 14 is measured using a scanning probe microscope SPM-9600 (made by Shimadzu Corporation). In this case, an NCHR made of silicon nitride (made by Nanoworld Co.) (spring constant of 42 N/m, and resonance frequency of 320 kHz) is used for a cantilever, and a probe with a flat region having a height of 10 μm, width of approximately 10×5 μm, and a tip radius of 10 nm is used. A phase mode is used for a measurement mode. A measuring frequency is 5 Hz. A measurement area of 50 μm×50 μm (256 pixels×256 pixels) is scanned for a topographic image, an amplitude image, sin δ, and cos δ, and then the microscopic surface roughness is calculated from the topographic image. In other words, calculation of the microscopic surface roughness is performed on a basis of a 50 μm square. Calculation of the ten-point mean roughness Rz as the surface roughness is performed in compliance with JIS B 0601 on a basis of the measured surface to show an average value of at least two measured points.

As a result, the relationship between the drying time (minutes) and the ten-point mean roughness Rz (JIS B 0601) as shown in FIG. 3 can be obtained. FIG. 4 depicts the graph showing the relationship between the drying time (minutes) and the ten-point mean roughness Rz (JIS B 0601).

This shows that the ten-point mean roughness Rz reduces as the drying time becomes longer, and that the ten-point mean roughness Rz becomes not more than 11 nm when the drying time is not less than 55 minutes. As this reason, it is thought that when the drying time is longer, the solvent volatilizes from endless belt 14 swollen with the solvent, and therefore endless belt 14 contracts, so that the surface roughness of endless belt 14 becomes smaller.

Meanwhile, in the measurement of the surface roughness specified by the current JIS, the tip radius of the probe is 2 μm. However, changes in the surface roughness of endless belt 14 at the time when the drying time is changed are not more than 2 μm. When the probe of the tip radius specified by the current JIS is used, the changes cannot be sensed when there is a slight change.

For this reason, although lengthy time is needed for development of new products and modification of manufacturing specifications, in the embodiment, the probe having the tip radius of 10 nm is used. In the embodiment, when the microscopic surface roughness is measured using the scanning probe microscope, the probe used for measurement has the tip radius of 10 nm. Accordingly, the changes of the surface roughness of endless belt 14 in accordance with variation of the drying time can be evaluated at an early stage, and therefore a manufacturing method can be promptly determined.

Subsequently, description is given of a relationship between the surface roughness of endless belt 14 and image density.

In the embodiment, for a fixed period of time and at room temperature, each of the ten types of endless belts 14 each having a different ten-point mean roughness is brought in contact with photosensitive drum 11, and then stretched around driving roller 19*a* and following rollers 19*b* and 19*c*. With image forming apparatus 10, an image having an image pattern of 100% density (solid printing, solid pattern) is printed, and density measurement is performed. Measurement of the image density is performed using a densitometer X-Rite 504 (made by X-Rite, Incorporated).

As a result, the relationship between the ten-point mean roughness and the image density as shown in FIG. 3 can be obtained. Additionally, imaging quality is evaluated on the basis of the image density. In this case, "excellent" indicates that the image density is not less than 1.2, "good" indicates that the image density is not less than 1.0 and is less than 1.2, and "poor" indicates that the image density is less than 1.0. As a result, the relationship between the ten-point mean roughness and the evaluation of the imaging quality as shown in FIG. 3 can be obtained. Note that measurement of the image density is not performed on endless belt 14 having the ten-point mean roughness of 1.5, since unevenness of the density occurs in the image in this case.

When the value of the ten-point mean roughness is less than 2.1, the toner retentivity on endless belt 14 is insufficient in the density correction process. Due to this, for instance, toner particles may be scattered when the toner image is formed on the surface of endless belt 14. For this reason, poor transfer occurs when the image is transferred onto recording medium 21. This causes the unevenness of the density in devices adopting the direct transfer system. Alternatively, in intermediate transfer system, poor transfer occurs poor toner images due to insufficient toner retentivity. Moreover, toner particles adhere to cleaning blade 18.

When the value of the ten-point mean roughness is larger than 11.0, endless belt 14 has a rougher surface so that the toner particles enter concave portions on the surface of endless belt 14. For that reason, an electric field for transfer is not sufficiently generated. Accordingly, transfer efficiency (ratio of the toner transferred onto recording medium 21 relative to the toner on the toner image on the surface of photosensitive drum 11) drops, so that the density of the toner image formed on recording medium 21 reduces.

Therefore, the ten-point mean roughness may be 11.0 to 2.1, and preferably, 9.1 to 2.1.

Thus, in the embodiment, the surface roughness of endless belt 14 is measured using the scanning probe microscope, and the value of the ten-point mean roughness in the 50 μm square is determined to be 11.0 to 2.1. Thereby, it is possible to early manufacture endless belt 14 that provides a higher printing density, less contamination of recording medium 21 caused by the toner remaining on endless belt 14, and fewer image defects caused by the solvent remaining in endless belt 14. Furthermore, occurrence of the poor transfer can be prevented so that a satisfactory image can be obtained. Additionally, an image of high quality can be obtained even in highly fine images, for example, having a resolution of 1200 dpi or 2400 dpi.

Since the change in the surface roughness among the drying times in the secondary drying process is smaller than the tip radius of the probe used for the surface roughness measurement specified by JIS (2 μm) (see below webpage: http://www.mitutoyo.co.jp/new/report/no238/topics/index.html), it has been hard to observe the change in the conventional macroscopic visual field. However, in the embodiment, the probe used for the scanning probe microscope has the smaller tip radius of 10 nm, and therefore, can sufficiently catch the changes of the surface roughness. Moreover, since convex and concave portions on the surface of endless belt 14 also influence a coefficient of friction, measurement in the fine area with the scanning probe microscope can serve as a sufficiently effective measurement method in molding endless belt 14 in the future.

Next, a second embodiment is described. When elements have the same structures as those of the components in the first embodiment, same reference numerals are given to the elements, and description thereof is omitted. Description of the same operation and effect as those in the first embodiment is also omitted.

FIG. 5 is a diagram showing a relationship among the ten-point mean roughness of an endless belt according to a second embodiment, coefficient of friction, and imaging quality.

In the embodiment, since the configuration and operation of image forming apparatus 10 are the same as those of the first embodiment, description thereof is omitted.

First, endless belt 14 is described. Endless belt 14 according to the second embodiment has the same elements as those of endless belt 14 according to the first embodiment, is manufactured with the same method and has the same properties as in the case of endless belt 14 according to the first embodiment, however, is different from endless belt 14 according to the first embodiment in that endless belt 14 according to the second embodiment contains a component for controlling microscopic coefficient of friction.

In the second embodiment, a soft segment component related to "elasticity and ductility" and a hard segment component that bears "rigidity" are included in the components mixed when endless belt 14 is molded. By adding these components, the rigidity of endless belt 14 can be controlled and, as a result, the coefficient of friction of endless belt 14 can be controlled.

In other words, the coefficient of friction can be made smaller by increasing the component of the hard segment, while the coefficient of friction can be made larger by increasing the component of the soft segment.

Note that, in the principal chain of polyamide-imide, a monomer that forms the hard segment includes, for example, p-phenylene diamine being aromatic diamine that is expressed by the following formula (2). Moreover, in the principal chain of polyamide-imide, a monomer that forms the soft segment includes, for example, hexamethylenediamine being aliphatic diamine that is expressed by the following formula (3).

[Chemical formula 2]

Formula (2)

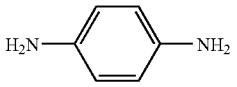

Formula (3)

$$H_2N-(CH_2)_6-NH_2$$

Note that, since other points are the same as those of endless belt 14 according to the first embodiment, description thereof is omitted.

Next, description is given of an evaluation method of endless belt 14 according to the embodiment.

First, description is given of the secondary drying process to volatilize a solvent used when endless belt 14 is molded.

In the embodiment, in order to control coefficient of friction of the fine area of endless belt 14, the secondary drying process to volatilize the solvent used when molding endless belt 14 is performed, for example, under an environment of 250° C. and for each of different process times of 40 minutes, 50 minutes, 55 minutes, 60 minutes, 70 minutes, 85 minutes, 100 minutes, 110 minutes, 115 minutes, and 150 minutes. Note that variation of the process time is the same as that of the first embodiment.

As a result, as shown in FIG. 5, ten types of endless belts 14 each having a different value of the ten-point mean roughness can be obtained. The relationship between the process time and the ten-point mean roughness is the same as the relationship shown in FIG. 3 described in the first embodiment.

For each of the ten types of endless belts 14 each having the different ten-point mean roughness, endless belts 14 having nine coefficients of friction as shown in FIG. 5 can be obtained by adjusting the components of the hard segment and the soft segment. In other words, a total of 90 types of endless belts 14 having a different combination of the ten-point mean roughness and the coefficient of friction can be obtained. The coefficient of friction shown in FIG. 5 is measured as follows.

Subsequently, description is given of measurement of coefficient of friction of the fine area on the surface of endless belt 14.

In the embodiment, measurement of the coefficient of friction of the fine area on the surface of endless belt 14 is performed using a scanning probe microscope SPM-9600 (made by Shimadzu Corporation). In this case, OMCL-RC800PSA (made of silicon nitride, and made by Olympus Corporation) (spring constant of 0.1 N/m, and resonance frequency of 19 kHz) is used for a cantilever, and measurement is performed in a lateral force mode. A 50 μm square selected at random is measured in at least two measuring points at a scan speed of 0.5 Hz and with a pressing force of 2.4 nN.

In the measurement of the coefficient of friction, lateral distortions that the cantilever observes in points of measurement (256 points×256 points) are divided according to a magnitude of each distortion (sample section), and the magnitude is defined as a frequency. Then, this frequency is used as a standard deviation to determine the section having the highest peak of the distortion. The scanning probe microscope can acquire round trip data (trace and retrace) in principle of the measurement. Therefore, the round trip data is averaged, and a frictional force is calculated from the averaged value, the spring constant of the cantilever, vertical load applied to the cantilever at the time of the measurement, and a torsional spring constant of the cantilever. Then, the coefficient of friction is calculated from these values (see below webpage: http://www.jpo.go.jp/shiryou/s_sonota/hyoujun_gijutsu/spm/01_mokuji.htm, and "2003 Result Report of Nanotechnology Support Program by Kyoto University (Kyoto University Heisei 15 Nen Nanoteku Sien Jigyouseika Houkokusho), M Kyodai H15-049 (Matsumoto, Kobayashi)").

Subsequently, description is given of a relationship between the coefficient of friction of the surface of endless belt 14 and an amount of adhered foreign substances.

In the embodiment, each of the 90 types of endless belts 14 are installed in image forming apparatus 10, and then an image having an image pattern with the density of 100% (solid printing, solid pattern) is printed onto recording medium 21 of a predetermined number of sheets (1000 sheets) under standard temperature and humidity conditions (JIS-8703). Subsequently, the images printed onto recording medium 21 are observed under the same condition, and the density thereof is measured in the similar manner as in the case of the first embodiment. In observation of the images, visual observation is performed as well as observation by use of a 200-power magnifier.

As a result, evaluation results of image quality as shown in FIG. 5 can be obtained for each of the total of the 90 types of endless belts 14 each having a different combination of the ten-point mean roughness and the coefficient of friction. The evaluation of the imaging quality is performed on the basis of existence of image defects such as white stripes or white spots. In this case, "excellent" indicates that the image density is not less than 1.2, and that neither white stripes nor the white spots can be found in the visual observation as well as in the observation by use of the 200-power magnifier. "Good" indicates that the image density is not less than 1.0, and that neither white stripes nor white spots can be found out in the visual observation. "Poor" indicates that the image density is less than 1.0, or that white stripes or white spots can be found out in the visual observation.

As shown in FIG. 5, when the coefficient of friction is larger than 1.40, printing of the image having the density of 100% generates an image defect such as white stripes patterns or white spots. When the coefficient of friction is 1.40, the image defect such as white stripe patterns or white spots is not observed in the visual observation. However, when the printed image is observed by use of the 200-power magnifier, white stripes patterns and white spots are observed. Moreover, when the coefficient of friction is not more than 1.20, in the visual observation and in the observation by use of the 200-power magnifier, neither white stripes patterns nor white spots are observed.

Then, when the ten-point mean roughness is 11.0 to 2.1 and the coefficient of friction is not more than 1.40, a satisfactory printed result is obtained, in which the image density is not less than 1.0, and in the visual observation, neither white stripes nor white spots are observed. Additionally, when the ten-point mean roughness is 9.1 to 2.1 and the coefficient of friction is not more than 1.20, a very desirable printed result is obtained, in which the image density is not less than 1.2, and in the visual observation and in the observation by use of the magnifier with the 200-power magnification, neither white stripes nor white spots are observed.

Meanwhile, no satisfactory image is obtained in the cases of the evaluation indicated by "poor" in which the white stripes or the white spots are observed in the visual observation, or the image density is less than 1.0.

When the coefficient of friction is larger than 1.40, the toner and paper powder are not cleaned from the surface of endless belt 14 and remain thereon. Accordingly, poor transfer occurs, so that the white stripes and the white spots are generated. Moreover, since the coefficient of friction is large, recording medium 21 is not easily separated from endless belt 14, and paper jam or adhesion of toner particles to cleaning blade 18 may occur.

In the embodiment, the coefficient of friction can be measured up to 0.01 only. This is because 0.01 is a limit value in the measurement of the coefficient of friction using the scanning probe microscope SPM-9600 (made by Shimadzu Corporation). It is more preferable that the coefficient of friction is closer to 0.

However, since it is difficult to make the coefficient of friction less than 0.01 for manufacturing reasons, the coefficient of friction is preferably not less than 0.01.

Thus, in the embodiment, the surface roughness of endless belt 14 is measured using the scanning probe microscope, the value of the ten-point mean roughness in the 50 μm square is determined to be 11.0 to 2.1, and the coefficient of friction is determined to be not more than 1.40. Thereby, the printing density becomes higher, and contamination of recording medium 21 caused by the toner remaining on endless belt 14 is reduced. Moreover, neither paper jam nor adhesion of toner particles to cleaning blade 18 occurs. Additionally, occurrence of poor transfer can be prevented so that a very desirable image can be obtained. Furthermore, an image of high quality can be obtained even in highly fine images, for example, having a resolution of 1200 dpi or 2400 dpi.

In the first embodiment, manufacturing conditions of endless belt 14 where the image density of 1.2 is satisfied cannot be determined. However, in the second embodiment, the manufacturing conditions can be more promptly determined by using the embodiment together with the first embodiment, when the coefficient of friction is larger than 0 and not more than 1.40.

Since a fine shape on the surface of endless belt 14 can be controlled by determination of process conditions by use of the coefficient of friction, obstruction of image formation caused by foreign substances adhered to recording medium 21 can be suppressed.

As described above, with an endless belt according to the embodiment, a transfer unit and an image forming apparatus using the endless belt according to the embodiment, occurrence of the poor transfer can be reduced and a highly fine image of high quality can be obtained.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An endless belt comprising a surface whose ten-point mean roughness measured with a scanning probe microscope is not less than 2.1 nm and less than 10.0 nm.

2. The endless belt according to claim 1, wherein a coefficient of friction of the surface of the endless belt is not more than 1.40, the coefficient of friction measured with the scanning probe microscope.

3. The endless belt according to claim 2, wherein a coefficient of friction of the surface of the endless belt is not less than 0.01, the coefficient of friction measured with the scanning probe microscope.

4. The image forming apparatus according to claim 3, wherein the volume resistivity of the endless belt is 1.0e-9 Ω·cm to 1.0e-12 Ω·cm, and the surface resistivity is 2.02e-12 $\Omega/cm^2$ to 1.0e-14 $\Omega/cm^2$.

5. The image forming apparatus according to claim 4, wherein the endless belt contains carbon black whose content is 3% to 40% by weight relative to the rest of the endless belt.

6. The endless belt according to claim 2, comprising at least an aromatic compound and an aliphatic compound.

7. The image forming apparatus according to claim 6, wherein the aromatic compound is p-phenylene diamine, and the aliphatic compound is hexamethylenediamine.

8. The endless belt according to claim 1, comprising at least an aromatic compound.

9. The image forming apparatus according to claim 1, wherein the endless belt is formed of a resin having a Young's modulus of 2000 MPa to 3000 MPa.

10. The image forming apparatus according to claim 9, wherein the endless belt is formed of one resin selected from the group consisting of polyimide, polycarbonate, polyamide, polyether ether ketone, polyvinylidene fluoride, and ethylene-tetrafluoroethylene copolymer, or is formed of a mixture of at least two resin selected from the group.

11. The image forming apparatus according to claim 1, wherein the surface whose ten-point mean roughness measured with a scanning probe microscope is not less than 2.1 nm and not more than 9.1 nm.

12. A transfer unit comprising:

an endless belt including a surface whose ten-point mean roughness measured with a scanning probe microscope is not less than 2.1 nm and less than 10.0 nm;

a driving roller configured to travel the endless belt;

a following roller configured to be driven by rotation of the driving roller; and a transfer member configured to transfer a developer image on an image carrier onto a medium or the endless belt.

13. The transfer unit according to claim 12, wherein a coefficient of friction of the surface of the endless belt is not more than 1.40, the coefficient of friction measured with the scanning probe microscope.

14. The transfer unit according to claim 13, wherein a coefficient of friction of the surface of the endless belt is not less than 0.01, the coefficient of friction measured with the scanning probe microscope.

15. The transfer unit according to claim 13, wherein the endless belt comprises at least an aromatic compound and an aliphatic compound.

16. The transfer unit according to claim 12, wherein the endless belt comprises at least an aromatic compound.

17. The transfer unit according to claim 12, further comprising a cleaning member that faces the endless belt, and is configured to remove a developer on the endless belt.

18. The transfer unit according to claim 12, further comprising a cleaning blade that contacts the endless belt, and is configured to remove the developer on the endless belt.

19. An image forming apparatus comprising:

a medium accommodation part configured to accommodate a medium;

a medium conveyance part configured to convey the medium;

an image formation unit configured to form a developer image based on image data;

a transfer unit configured to transfer the developer image formed by the image formation unit onto the medium; and a fixing part configured to fix the developer image onto the medium; wherein the transfer unit comprises:

an endless belt including a surface whose ten-point mean roughness measured with a scanning probe microscope is not less than 2.1 nm and less than 10.0 nm;

a driving roller configured to travel the endless belt;

a following roller configured to be driven by rotation of the driving roller; and a transfer member configured to transfer a developer image on an image carrier onto a medium or the endless belt.

20. The image forming apparatus according to claim 19, wherein a coefficient of friction of the surface of the endless belt is not more than 1.40, the coefficient of friction measured with the scanning probe microscope.

21. The image forming apparatus according to claim 20, wherein a coefficient of friction of the surface of the endless belt is not less than 0.01, the coefficient of friction measured with the scanning probe microscope.

22. The image forming apparatus according to claim 20, wherein the endless belt comprises at least an aromatic compound and an aliphatic compound.

23. The image forming apparatus according to claim 19, wherein the endless belt comprises at least an aromatic compound.

24. The image forming apparatus according to claim 19, further comprising a cleaning member that faces the endless belt, and is configured to remove a developer on the endless belt.

25. The image forming apparatus according to claim 19, further comprising a cleaning blade that contacts the endless belt, and is configured to remove the developer on the endless belt.

26. The image forming apparatus according to claim 19, wherein the surface whose ten-point mean roughness measured with a scanning probe microscope is not less than 2.1 nm and not more than 9.1 nm.

* * * * *

UNITED STATES PATENT AND TRADEMARK OFFICE

CERTIFICATE OF CORRECTION

PATENT NO. : 8,290,412 B2
APPLICATION NO. : 12/365271
DATED : October 16, 2012
INVENTOR(S) : Naoki Masui It is certified that error appears in the above-identified patent and that said Letters Patent is hereby corrected as shown below:

Claim 4, 5, 7, 9, 10, and 11 shown in column 12, lines 32-58 should appear as follows:

4. The endless belt according to claim 3, wherein the volume resistivity of the endless belt is 1.0e-9 Ω•cm to 1.0e-12 Ω•cm, and the surface resistivity is 2.02e-12 Ω/cm2 to 1.0e-14 Ω/cm2.

5. The endless belt according to claim 4, wherein the endless belt contains carbon black whose content is 3% to 40% by weight relative to the rest of the endless belt.

7. The endless belt according to claim 6, wherein the aromatic compound is p-phenylene diamine, and the aliphatic compound is hexamethylenediamine.

9. The endless belt according to claim 1, wherein the endless belt is formed of a resin having a Young's modulus of 2000 MPa to 3000 MPa, 10. The endless belt according to claim 9, wherein the endless belt is formed of one resin selected from the group consisting of polyimide, polycarbonate, polyamide, polyether ether ketone, polyvinylidene fluoride, and ethylene-tetrafluoroethylene copolymer, or is formed of a mixture of at least two resin selected from the group.

11. The endless belt according to claim 1, wherein the surface whose ten-point mean roughness measured with a scanning probe microscope is not less than 2.1 nm and not more than 9.1 nm.

Signed and Sealed this
Fifth Day of February, 2013

Teresa Stanek Rea
*Acting Director of the United States Patent and Trademark Office*